US010688529B2

(12) United States Patent
Riegle et al.

(10) Patent No.: US 10,688,529 B2
(45) Date of Patent: Jun. 23, 2020

(54) APPARATUS AND METHOD FOR CLEANING AND INSPECTING A ROTARY SIFTER

(71) Applicant: Prater Industries, Inc., Bolingbrook, IL (US)

(72) Inventors: Joshua Howard Riegle, Manteno, IL (US); Swapna Reddy Chilukuri, Naperville, IL (US); David Arthur Smith, Brownsburg, IN (US)

(73) Assignee: Prater Industries, Inc., Bolingbrook, IL (US)

( * ) Notice: Subject to any disclaimer, the term of this patent is extended or adjusted under 35 U.S.C. 154(b) by 15 days.

(21) Appl. No.: 16/048,522

(22) Filed: Jul. 30, 2018

(65) Prior Publication Data

US 2020/0030852 A1 Jan. 30, 2020

(51) Int. Cl.
*B07B 1/20* (2006.01)
*B07B 1/42* (2006.01)
*B07B 1/50* (2006.01)

(52) U.S. Cl.
CPC ..... *B07B 1/20* (2013.01); *B07B 1/42* (2013.01); *B07B 1/50* (2013.01)

(58) Field of Classification Search
CPC ..... B07B 1/20; B07B 1/42; B07B 1/50
USPC ..... 209/284, 285, 286, 288
See application file for complete search history.

(56) References Cited

U.S. PATENT DOCUMENTS 2,216,914 A * 10/1940 Holtzman ..... A01F 12/442 209/240
6,193,072 B1 * 2/2001 Link ..... B07B 1/20 209/286
9,370,796 B2 * 6/2016 Maynard ..... B07B 1/20

FOREIGN PATENT DOCUMENTS

JP 2000024551 A 1/2000

* cited by examiner

*Primary Examiner* — Terrell H Matthews
(74) *Attorney, Agent, or Firm* — Young Basile Hanlon & MacFarlane, P.C.

(57) ABSTRACT

In one aspect of the present disclosure, a rotary sifter is disclosed that includes a body assembly, a drive mechanism, and a base assembly supporting the body assembly and the drive mechanism. The body assembly includes a housing, a screen frame assembly that is positioned within the housing, and a rotor assembly mounted for rotation within the screen frame assembly. The drive mechanism is in mechanical cooperation with the rotor assembly to rotate the rotor assembly, and is axially fixed in relation to the housing, the screen frame assembly, and the rotor assembly. The base assembly includes a guide rail system that is configured and dimensioned to permit longitudinal movement of the rotor assembly and the screen frame assembly in relation to the housing and the drive mechanism to allow for removal of the rotor assembly and the screen frame assembly from the housing.

19 Claims, 6 Drawing Sheets

APPARATUS AND METHOD FOR CLEANING AND INSPECTING A ROTARY SIFTER

CROSS-REFERENCE TO RELATED APPLICATION(S)

None.

TECHNICAL FIELD

The present disclosure relates to rotary (centrifugal) sifters, and more particularly, to improvements in the inspection, cleaning, and removal of rotor and screen assemblies from a rotary sifter.

BACKGROUND

Industrial rotary (centrifugal) sifters are commonly used to scalp and/or sift various materials and products (e.g., bakery mixes and ingredients, plants, confectionaries, powders, etc.). Such rotary sifters are designed to separate particles into two product streams, or alternatively, to remove tramp or undesirable materials from the desired material. An example of a previously known rotary sifter is shown in FIG. 1, wherein a rotary sifter 1 generally includes a stand 2 supporting a body assembly 3 with an inlet 4 for receiving media and a first outlet 5 for the discharge of the desired media or material after sifting, and a second outlet (not shown) for the discharge of undesired media or material. The body assembly 3 houses a screen frame assembly 6 (the screen is not shown for clarity) and a rotor assembly 7 that is mounted for rotation within the screen frame assembly 6. The rotor assembly 7 is driven by an external motor 8 through the use of a belt (not shown, as the belt is covered by a cover 9) connected to the motor 8 and located adjacent the inlet 4.

From time to time, rotary sifters must be inspected and cleaned, during which, several internal components must be removed, including, for example, the screen frame assembly 6 and the rotor assembly 7. To do so, a side door 10 in the body assembly 3 is unfastened and opened such that the screen frame assembly 6 and the rotor assembly 7 can be viewed and if needed, an end door 11 and screen and bearing retainer 12 in the body assembly are unfastened and opened to allow for access to, and removal of, the screen frame assembly 6 and the rotor assembly 7. The screen frame assembly 6 is pulled and removed from the body assembly 3 through the screen and bearing retainer 12 and end door 11 followed by the rotor assembly 7, and the screen and rotor assemblies 6, 7 are then cleaned and inspected. Once cleaned and inspected, the screen and rotor assemblies 6, 7 must be properly aligned and re-inserted into the body assembly 3 through the screen and bearing retainer 12 and end door 11.

Due to their weight and size, removing and replacing the screen frame assembly 6 and the rotor assembly 7 can be cumbersome and time consuming, as removal and replacement of the screen and rotor assemblies 6, 7 often requires more than one person. Additionally, in conventional designs, the screen frame assembly 6 and the rotor assembly 7 must be moved to a separate area for cleaning and inspection. Thus, manually removing, cleaning, and replacing the screen and rotor assemblies 6, 7 is a timely and laborious process that requires the rotary sifter to be shut down thereby decreasing production time and increasing labor costs. Both of these factors decrease the efficiency of the rotary sifter process which is undesirable in an industrial environment.

The present disclosure addresses these issues by providing a rotary sifter that allows for easier and faster inspection and cleaning than previous rotary sifter designs thereby reducing production downtime and labor cost, so as to increase the efficiency of the rotary sifter process.

SUMMARY

In one aspect of the present disclosure, a rotary sifter is disclosed that includes a body assembly, and a base assembly supporting the body assembly and the drive mechanism. The body assembly includes a housing, a screen frame assembly that is positioned within the housing, and a rotor assembly mounted for rotation within the screen frame assembly. The drive mechanism is in mechanical cooperation with the rotor assembly to rotate the rotor assembly and is axially fixed in relation to the housing, the screen frame assembly, and the rotor assembly. The base assembly includes a guide rail system that is configured and dimensioned to permit longitudinal movement of the rotor assembly and the screen frame assembly in relation to the housing and the drive mechanism to allow for removal of the rotor assembly and the screen frame assembly from the housing.

In certain embodiments, the drive mechanism may be disconnectable from the rotor assembly such that the rotor assembly and the screen frame assembly can be removed from the housing without the drive mechanism.

In certain embodiments, the body assembly may include an end plate supporting the screen frame assembly and the rotor assembly such that the end plate is movable in conjunction with the screen frame assembly and the rotor assembly.

In certain embodiments, the end plate may be configured and dimensioned for axial and rotational movement in relation to the housing to cause corresponding axial and rotational movement of the screen frame assembly and the rotor assembly.

In certain embodiments, the end plate may include a pivot plate that is connectable to a pivot bearing to facilitate rotation of the pivot plate and the end plate in relation to the housing.

In certain embodiments, the pivot bearing may include an outer ring and an inner ring in mechanical engagement with the outer ring such that the inner ring is rotatable in relation to the outer ring. In such embodiments, the pivot plate may be connectable to the inner ring.

In certain embodiments, the rotary sifter may further include a guide plate that is configured and dimensioned to support the pivot bearing such that the pivot bearing is rotatable in relation to the guide plate.

In certain embodiments, the guide plate may be in mechanical engagement with the guide rail system such that the guide plate is longitudinally movable along the guide rail system together with the end plate, the screen frame assembly, and the rotor assembly.

In certain embodiments, the guide rail system may include a first guide rail and a second guide rail laterally offset from the first guide rail.

In certain embodiments, the first and second guide rails may be positioned on opposing sides of the base assembly.

In another aspect of the present disclosure, a rotary sifter is disclosed that includes a base assembly, a body assembly positioned atop the base assembly that includes an end plate supporting a rotor assembly and a screen frame assembly, and a drive mechanism in mechanical cooperation with the rotor assembly to rotate the rotor assembly within the housing. The drive mechanism and the end plate are positioned adjacent opposing longitudinal ends of the housing such that the end plate, the rotor assembly, and the screen frame assembly are concomitantly movable in relation to the drive mechanism.

In certain embodiments, the end plate, the rotor assembly, and the screen frame assembly may be axially movable in relation to the housing such that the rotor assembly and the screen frame assembly are removable from the housing.

In certain embodiments the rotary sifter may further include a longitudinal guide rail system supporting the end plate to permit axial movement of the end plate, the rotor assembly, and the screen frame assembly in relation to the housing.

In certain embodiments, the guide rail system may include a first guide rail and a second guide rail laterally offset from the first guide rail and substantially parallel to one another.

In certain embodiments, the end plate, the rotor assembly, and the screen frame assembly may be configured, dimensioned, and connected for concomitant rotation in relation to the housing.

In certain embodiments, the end plate may include a pivot plate that is connectable to a rotatable pivot bearing to facilitate rotation of the pivot plate and the end plate in relation to the housing.

In certain embodiments, the rotary sifter may further include a guide plate that is configured and dimensioned to support the pivot bearing such that the pivot bearing is rotatable in relation to the guide plate.

In certain embodiments, the guide plate may define an opening that is configured and dimensioned to receive the pivot bearing.

In another aspect of the present disclosure, a rotary sifter is disclosed that includes a housing configured and dimensioned to removably receive a rotor assembly and a screen frame assembly, and a drive mechanism in mechanical cooperation with the rotor assembly to rotate the rotor assembly within the screen frame assembly. The rotor assembly and the screen frame assembly are supported within the housing such that the rotor assembly and the screen frame assembly are axially movable in relation to the drive mechanism.

In another aspect of the present disclosure, a method is disclosed for disassembling a rotary sifter that includes a screen frame assembly and a rotor assembly rotatable by a drive mechanism. The method includes: (i) unlocking an end plate from a housing of the rotary sifter; (ii) axially repositioning the end plate in relation to the housing to disconnect the rotor assembly from the drive mechanism; and (iii) withdrawing the rotor assembly and the screen frame assembly from the housing by moving the rotor assembly and the screen frame assembly axially in relation to the drive mechanism.

In certain embodiments, axially repositioning the end plate may include sliding the end plate along a guide rail system.

In certain embodiments, sliding the end plate along the guide rail system may include sliding the end plate along first and second guide rails that are laterally offset from each other.

In certain embodiments, sliding the end plate along the guide rail system may include sliding a pivot plate of the end plate together with a guide plate that is mechanically connected to the pivot plate via a pivot bearing positioned between the pivot plate and the guide plate.

In certain embodiments, the method may further include rotating the pivot plate in relation to the guide plate via the pivot bearing to cause angular displacement of the end plate, the rotor assembly, and the screen frame assembly in relation to the housing.

In certain embodiments, rotating the pivot plate may include causing an inner ring of the pivot bearing to rotate in relation to an outer ring of the pivot bearing, the pivot plate being connectable to the inner ring of the pivot plate.

BRIEF DESCRIPTION OF THE DRAWINGS

The invention is best understood from the following detailed description when read in conjunction with the accompanying drawings. It is emphasized that, according to common practice, the various features of the drawings may not be to-scale and may be arbitrarily expanded or reduced for clarity.

DETAILED DESCRIPTION

Figure 1:
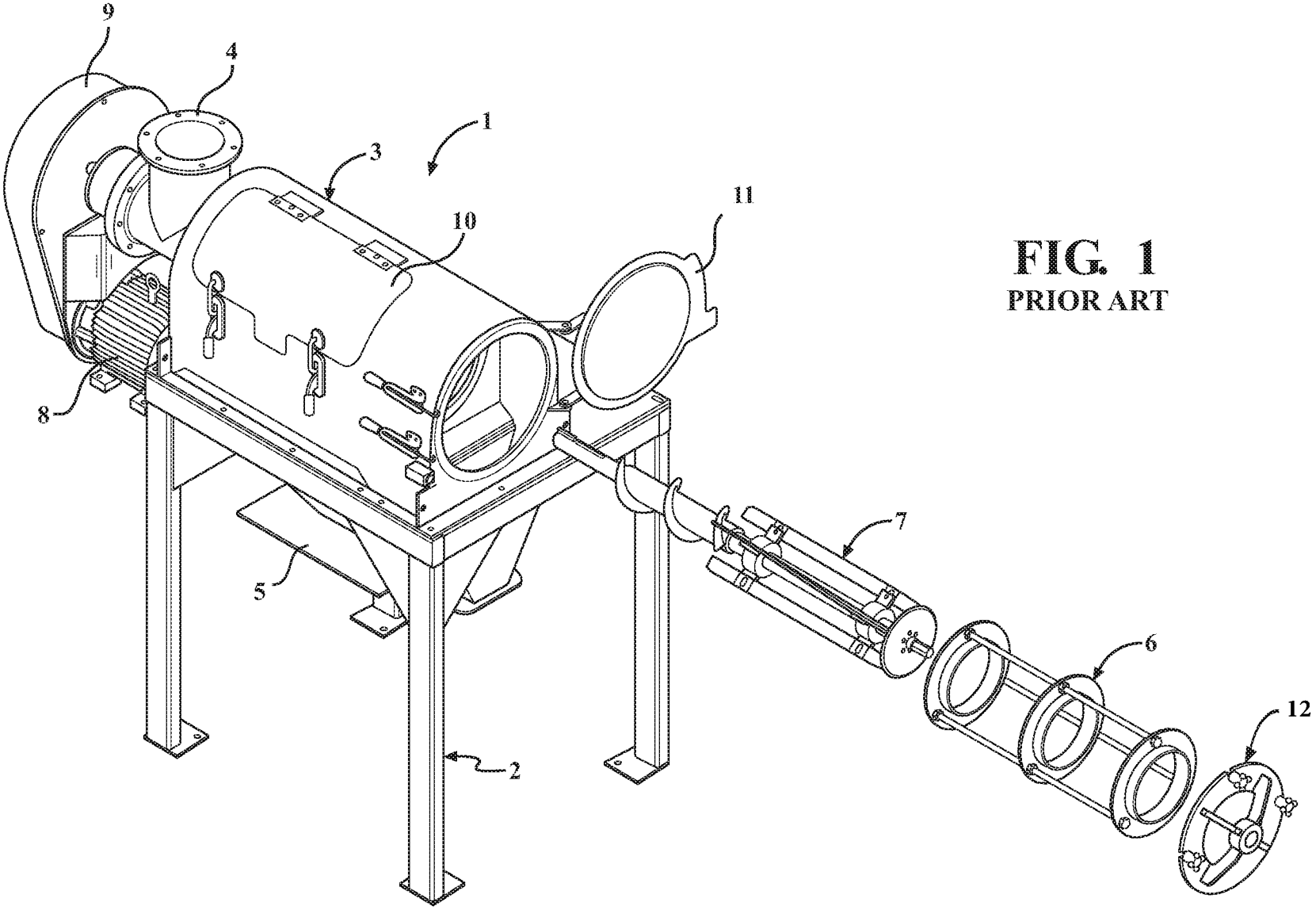
FIG. 1 PRIOR ART
FIG. 1 is rear, perspective view of a known rotary (centrifugal) sifter.

The present disclosure describes an improved industrial rotary (centrifugal) sifter that allows for the simple and quick removal of the screen and rotor assemblies from the rotary sifter so as to reduce the downtime and labor costs associated with inspecting, removing, and cleaning the screen and rotor assemblies of the rotary sifter thereby increasing the efficiency of the rotary sifter process. The improved rotary sifter includes a body assembly and a base assembly supporting the body assembly and the drive mechanism. The body assembly includes a housing, and an end plate that supports internal rotor and screen assemblies within the housing such that the rotor assembly is rotatable within the screen frame assembly to scalp, sift, or otherwise process media or various materials, such as bakery mixes and ingredients, plants, confectionaries, powders, etc. The presently disclosed rotary sifter allows for easier and quicker inspection, disassembly, cleaning, and reassembly of the screen and rotor assemblies compared to known rotary sifter systems by allowing for the guided removal of the end plate, the rotor assembly, and the screen frame assembly using a guide rail system. During disassembly, the end plate, the rotor assembly, and the screen frame assembly are longitudinally separated from the housing and the drive mechanism using a guide plate that is slidably supported by the guide rail system. After the rotor and screen assemblies are fully removed from the housing, the end plate, the rotor assembly, and the screen frame assembly can be pivoted in relation to the housing and the drive mechanism to allow for continued disassembly, inspection, and cleaning of the rotor assembly and the screen frame assembly.

By supporting the rotor assembly and the screen frame assembly during disassembly and reassembly, the inspection and cleaning process can be simplified by reducing the requisite time and labor required compared to processes associated with other known rotary sifter systems. In addition, by allowing the drive mechanism to remain stationary and disconnected from the rotor and screen assemblies, a significant amount of weight is eliminated from the disassembly/reassembly process, thereby further simplifying and increasing the ease with which the process is completed.

FIGS. 2-6 illustrate the presently disclosed improved rotary sifter 1000, which includes a base assembly 100 and a body assembly 200 supported by the base assembly 100. The base assembly 100 extends along a longitudinal axis X and includes a unitary frame 101 having a primary stand 102 and a secondary stand 104. The primary stand 102 is configured and dimensioned to support the body assembly 200 and includes a frame 106 with a plurality of legs 108 that are interconnected by a plurality of longitudinal and transverse support members (struts) 110. To permit movement of the rotary sifter 1000, the base assembly 100 may include a series of caster wheels 112 mounted to the bottom of each of the plurality of legs 108. By way of a non-limiting example, four legs 108 and caster wheels 112 are shown on the primary stand 102 along with three struts 110.

The secondary stand 104 is configured and dimensioned to support various internal components of the body assembly 200 during disassembly and reassembly of the rotary sifter 1000, as discussed below. The secondary stand 104 is connected to, and extends from, the primary stand 102, and includes a frame 114 with a pair of forward legs $\mathbf{116}_A$ and a pair of rearward legs $\mathbf{116}_B$ having upper ends $\mathbf{118}_B$. The forward legs $\mathbf{116}_A$ may be common with or combined with a pair of the legs 108 from the primary stand 102. As in the primary stand 102, the legs $\mathbf{116}_A$, $\mathbf{116}_B$ of the secondary stand 104 are interconnected by a plurality of longitudinal and transverse support members (struts) 120. The forward legs $\mathbf{116}_A$ each define a first height $H_A$, and the rearward legs $\mathbf{116}_B$ each define a second height $H_B$ greater than the first height $H_A$. To permit movement of the secondary stand 104, each of the forward legs $\mathbf{116}_A$ and rearward legs $\mathbf{116}_B$ have casters 112 mounted thereon similar to the primary stand 102. By way of a non-limiting example, the secondary stand 104 may have two forward legs $\mathbf{116}_A$ and two rearward legs $\mathbf{116}_B$ wherein the forward legs $\mathbf{116}_A$ may be common with the legs 108 from the primary stand 102. In addition, the secondary stand 104 may have four caster wheels 112 and four struts 120 wherein two of the caster wheels 112 may be common with the caster wheels 112 on the primary stand 102.

Figure 6:
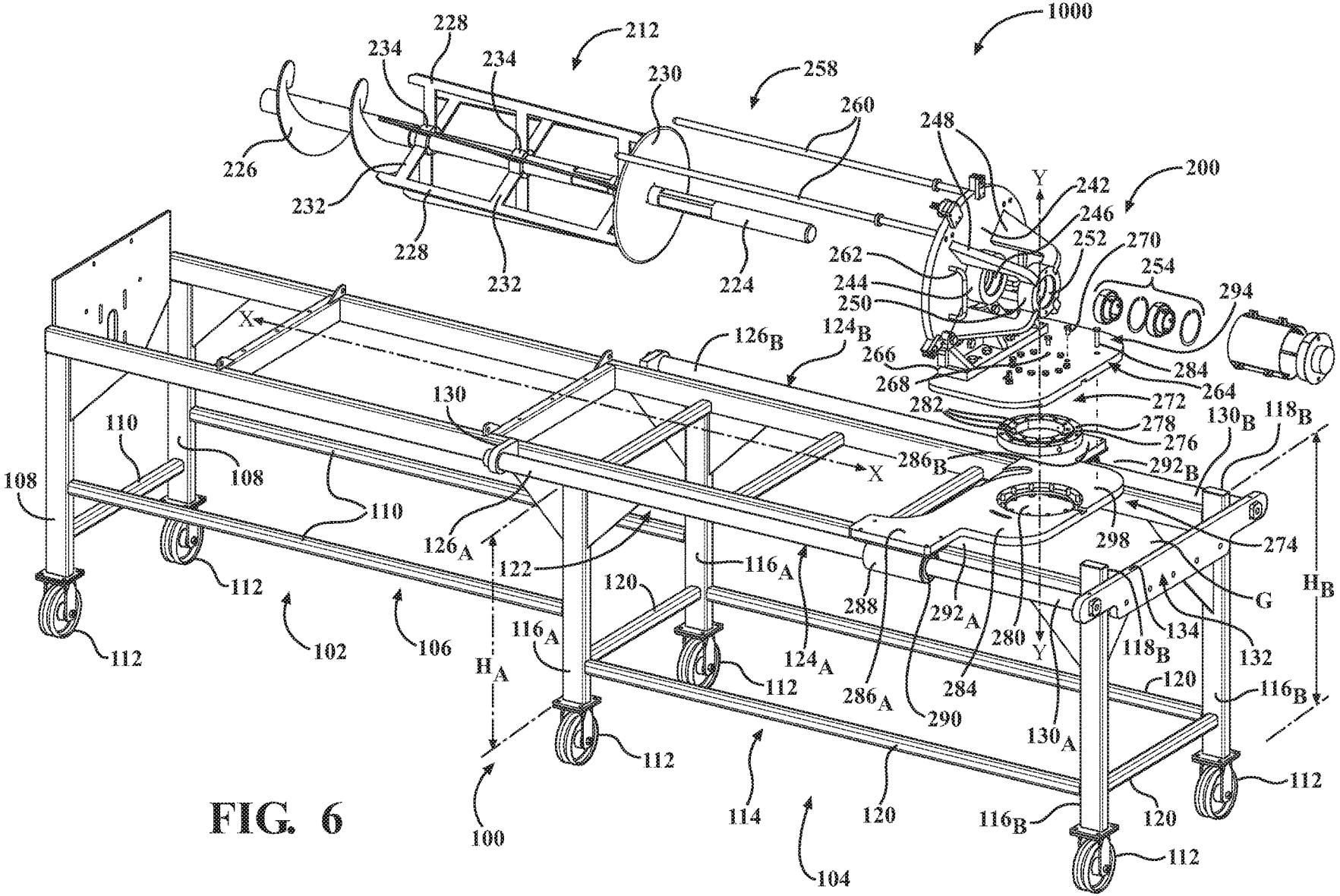
FIG. 6 is a partial, rear, exploded perspective view of the rotary sifter.

As seen in FIG. 6, the secondary stand 104 further includes a guide rail system 122 having a first guide rail $\mathbf{124}_A$ and a second guide rail $\mathbf{124}_B$. The guide rails $\mathbf{124}_A$, $\mathbf{124}_B$ are laterally (horizontally) offset from each other such that they are positioned on opposing sides (e.g., right and left sides) of the base assembly 100 and extend along the longitudinal axis X in a substantially parallel relation to the frames 106, 114 and to each other. The guide rails $\mathbf{124}_A$, $\mathbf{124}_B$ include forward ends $\mathbf{126}_A$, $\mathbf{126}_B$ that are supported by braces 130 connected to and extending laterally from the secondary stand 104 and rearward ends $\mathbf{130}_A$, $\mathbf{130}_B$ that are supported and connected by a rail guide plate 132. The rail guide plate 132 defines an upper edge 134 that is positioned beneath (vertically below) the upper ends $\mathbf{118}_B$ of the rearward legs $\mathbf{116}_B$ to define a gap G (discussed in further detail below).

In various embodiments, it is envisioned that the primary stand 102 and the secondary stand 104 may be fixedly connected to one another so as to form the unitary frame 101. Alternatively, it is envisioned that the primary and secondary stands 102, 104 may be releasably connected such that the secondary stand 104 can be moved in relation to the primary stand 102 (e.g., for storage when not in use).

Figure 2:
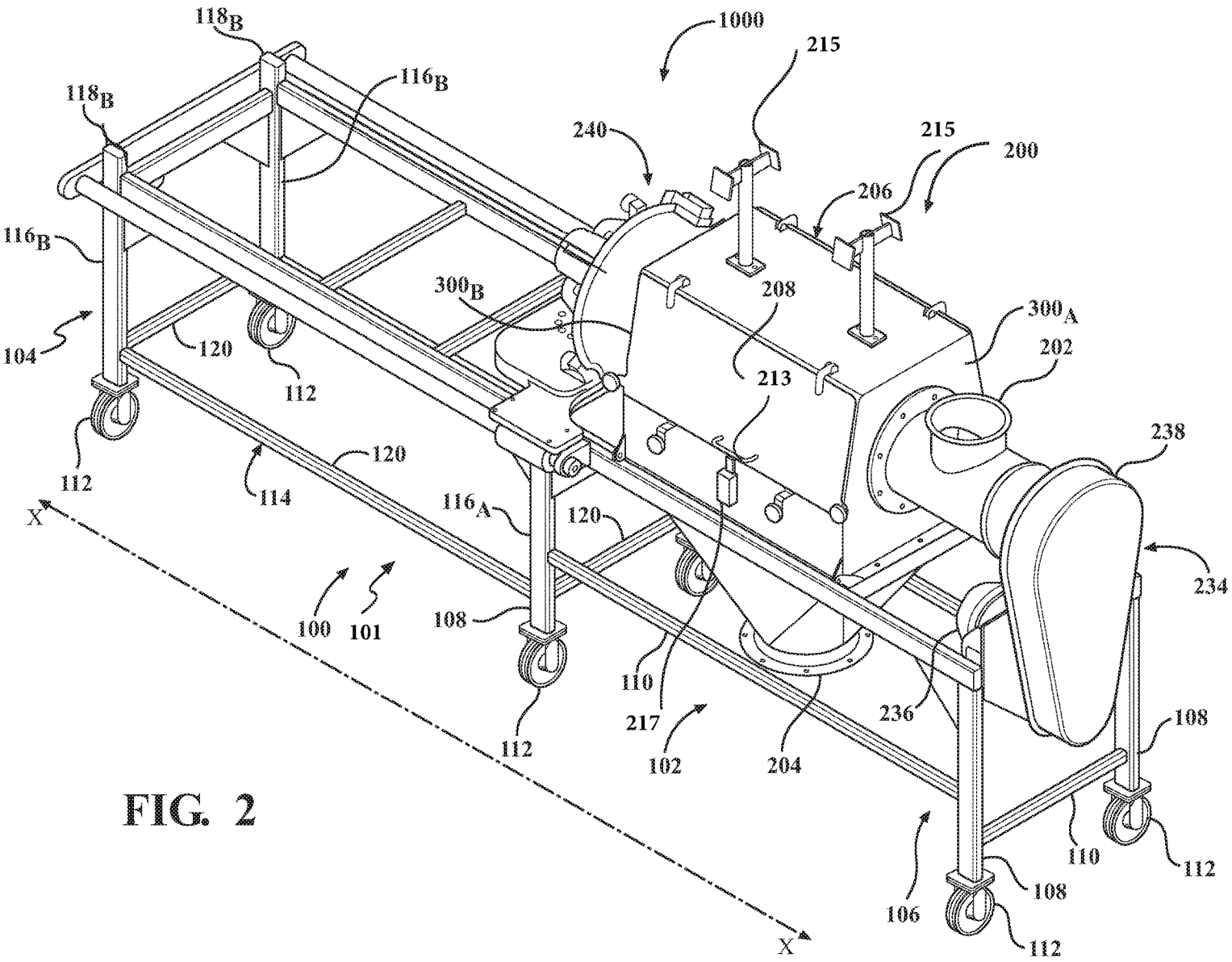
FIG. 2 is a front, perspective view of a rotary (centrifugal) sifter according to the principles of the present disclosure including a rotor assembly and a screen frame assembly.

To process media or material through the rotary sifter 1000, the body assembly 200 includes an inlet 202, as shown in FIG. 2, for receiving the media or materials, such as bakery mixes and ingredients, plants, confectionaries, powders, etc. Once the media or material is processed through the rotary sifter 1000, a primary outlet 204 allows for the discharge of the finished or desired media after processing, and a secondary outlet (not shown) allows for the discharge of the waste or undesired media after processing. The body assembly 200 further includes a housing 206 with one or more side doors 208 that allow for access to internal components of the body assembly 200, which may include a screen frame assembly 210, shown in FIGS. 3 and 5, and a rotor assembly 212, shown in FIGS. 3 and 6, that is mounted for rotation within the screen frame assembly 210. In the illustrated embodiment, the door(s) 208 are configured to open from bottom to top (i.e., via hinges or the like positioned adjacent a top edge of the door(s) 208). The door(s) 208 provide a handle 213 mounted thereon for operably swinging the door(s) 208 between an open and a closed position. Positive stops 215 are connected to and extend upward form the top of the housing 206 to limit the range the door(s) 208 can swing in the open position. A latch 217 is connected to the housing 206 to secure the door(s) 208 in the closed position. However, it is anticipated that the doors 208 can be configured or mounted in any manner to provide a desired position for opening and closing the doors 208.

Figure 3:
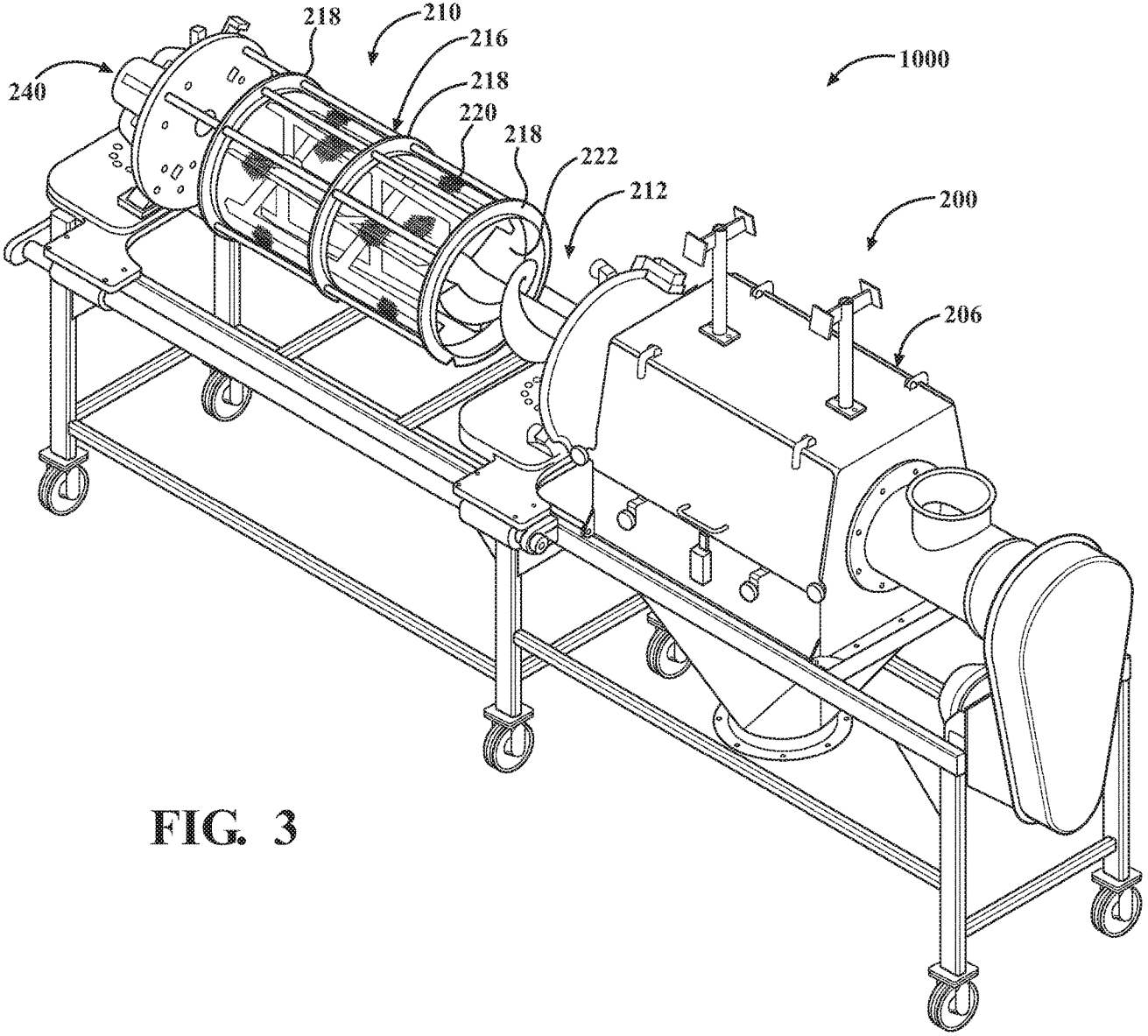
FIG. 3 is a front, perspective view of the rotary sifter seen in FIG. 2 with the rotor assembly and the screen frame assembly removed from the body assembly.

To separate the desired media or material from the undesirable media or material, the screen frame assembly 210 includes a substantially cylindrical housing 216, as shown in FIG. 3, having a plurality of annular collars 218 that are longitudinally spaced and substantially parallel with one another. A mesh screen 220 is supported by the collars 218 such that the screen 220 forms the substantially cylindrical shape of the housing 216 thereby defining an internal cavity 222 that is configured and dimensioned to removably receive the rotor assembly 212 and the media after insertion of the media through the inlet 202 of the body assembly 200.

The rotor assembly 212 includes a substantially cylindrical, central shaft 224 that extends along a horizontal axis, as shown in FIG. 6. The central shaft 224 supports a helical auger (conveyor) 226, a series of vanes 228, and a backing plate 230 that closes off a rearward end of the internal cavity 222 of the screen frame assembly 210, as shown in FIG. 3. The helical auger 226 is connected to the end of the central shaft 224 and provides a continuous helical blade that feeds and moves the media longitudinally from the inlet 202 of the body assembly 200 into the screen frame assembly 210. The vanes 228 are horizontally spaced from and adjacent to the helical auger 226 along the central shaft 224 and provide a slight helical angle to move the media longitudinally through the screen frame assembly 210. The vanes 228 are connected to the central shaft 224 via arms 232 that are connected to and extend substantially perpendicularly outward from collars 234. The collars 234 have a substantially cylindrical configuration and receive and are connected to the central shaft 224 through an inner bore of the collars 234. In various embodiments, it is envisioned that components of the rotor assembly 212 (e.g., the auger 226, the shaft 224, the arms 234, the collars 234, the vanes 228, etc.) may be discrete structures that are secured together through any suitable method of manufacture (e.g., press-fit, welding, fasteners, etc.). Alternatively, it is envisioned that one or more components of the rotor assembly 212 may be integrally (e.g., monolithically) formed. For example, as seen in FIG. 6, the auger 226 may be unitarily formed with the shaft 224.

As shown in FIGS. 2, 3, and 6, the rotor assembly 212 is driven by an external drive mechanism 234 including a motor 236 and a belt (not shown) enclosed within a cover 238 that cooperate to rotate the rotor assembly 212 within the housing 206 and the screen frame assembly 210. It is envisioned that the rotor assembly 212 and the drive mechanism 234 may be connected in any manner, and using any structure, suitable for the intended purpose of facilitating rotation of the rotor assembly 212 by the drive mechanism 234. For example, the central shaft 224 of the rotor assembly 212 and the drive mechanism 234 may include corresponding engagement structures, such as, for example, mating splines, a key and keyway, a detent arrangement, etc. As the rotor assembly 212 rotates, the auger 226 draws media from the inlet 202 of the body assembly 200 into the internal cavity 222 defined by the screen frame assembly 210 for agitation of the media by the vanes 228 and sifting of the media through the screen 220. As the desired portion of the media that is smaller than the openings in the mesh screen 220 passes through the screen 220, the desired portion of the media is routed through the primary outlet 204 for collection. The undesired portion of the media that is larger than the openings in the mesh screen 220 is prevented from passing through the screen 220 and is routed through the secondary outlet for disposal.

Figure 4:
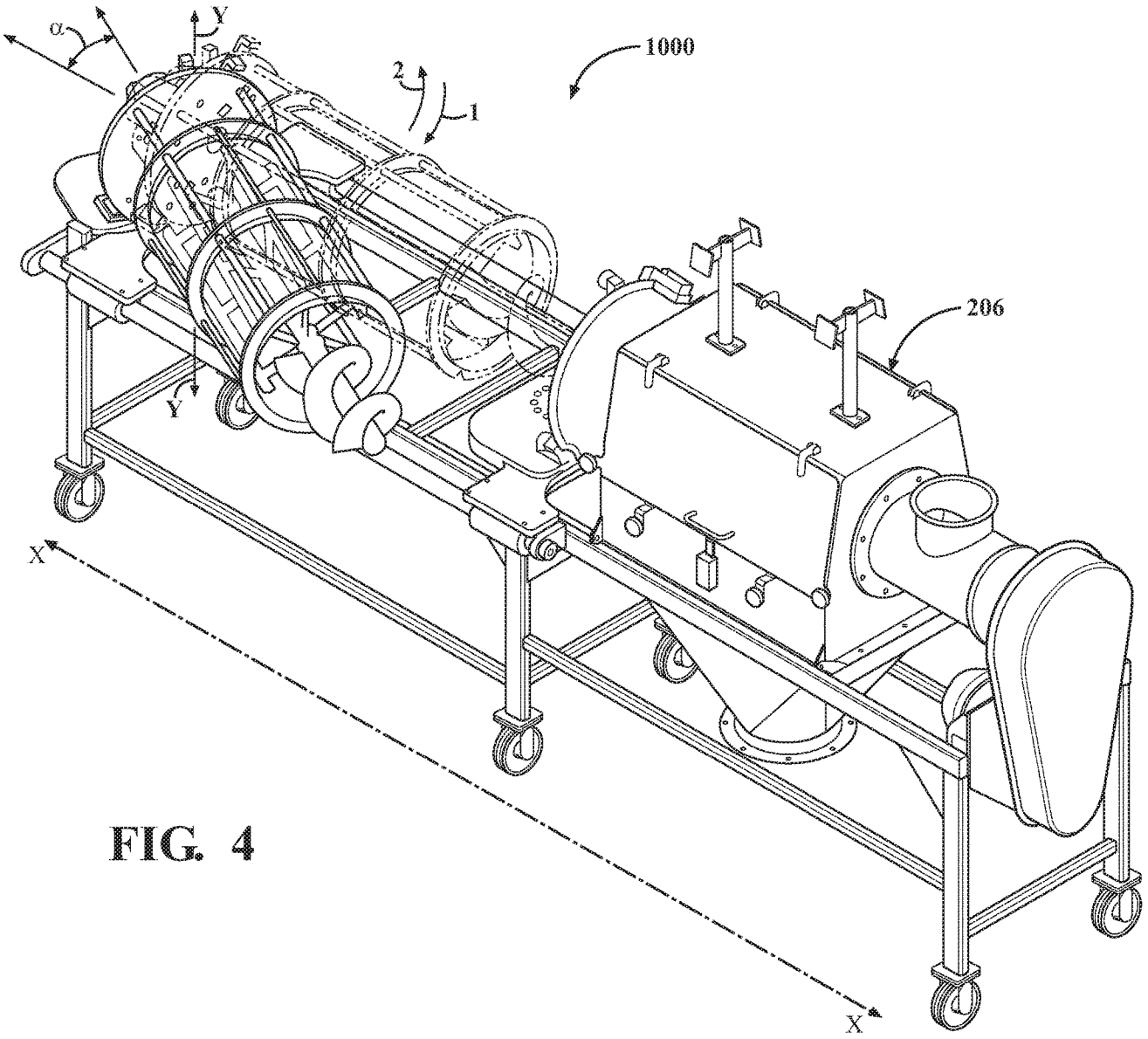
FIG. 4 is a front, perspective view of the rotary sifter with the rotor assembly and the screen frame assembly removed and shown after angular displacement thereof.
Figure 5:
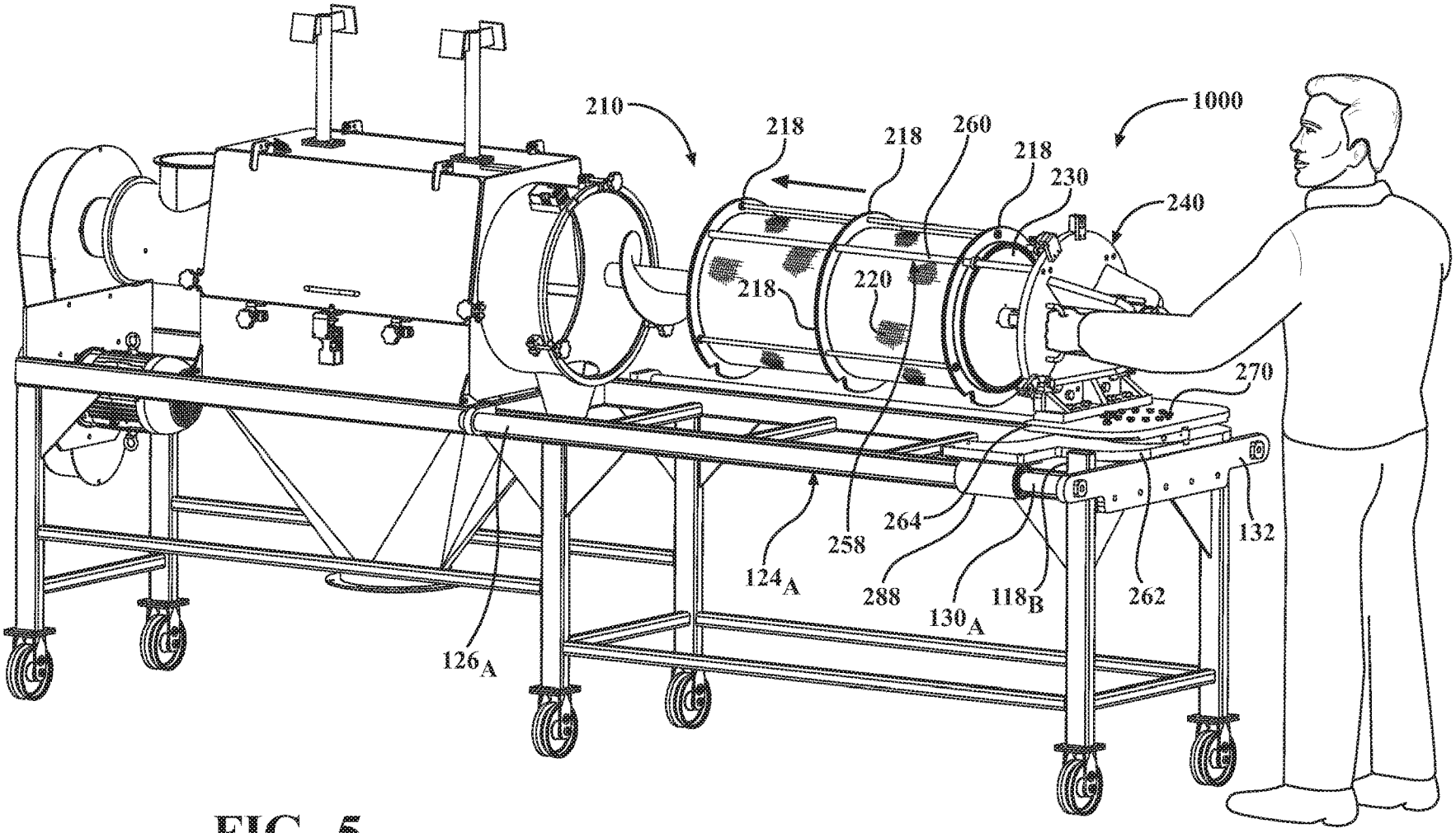
FIG. 5 is a rear, perspective view of the rotary sifter with the rotor assembly and the screen frame assembly removed from the body assembly and shown before angular displacement thereof.

The body assembly 200 further includes an end plate 240 that is movable in relation to the housing 206 of the body assembly 200 to allow for removal, inspection, and replacement of the screen frame assembly 210 and the rotor assembly 212 in accordance with the discussion below. More specifically, the end plate 240 is repositionable between a first position, as shown in FIG. 2, in which the end plate 240 sealingly engages the housing 206, and a second position, as shown in FIGS. 3-5, in which the end plate 240 is disengaged from the housing 206 thereby allowing the rotor assembly 212 and the screen frame assembly 210 to be exposed to facilitate inspection, cleaning, removal, etc. Providing for the sealed engagement between the end plate 240 and the housing 206 eliminates the need for the end door 11, as seen in FIG. 1, typically included in previously known rotary sifters.

The end plate 240 is connected to the rotor assembly 212 to support the rotor assembly 212 and the screen frame assembly 210 during operation, disassembly, inspection, cleaning, and reassembly of the rotary sifter 1000. More specifically, the end plate 240 provides a substantially circular disc 242 having a boss 244 connected to the center of the disc 242 and extending away from the housing 206. An aperture 246 extends through the boss 244 and the disc 242 of the end plate 240. A plurality of longitudinal supports 248 are also connected to the disc 242 of the end plate 240 and extend longitudinally away from the housing 206. In a non-limiting example, there may be four longitudinal supports 248 extending from the disc 242. The longitudinal supports 248 support a substantially cylindrical coupling 250 having an aperture 252 extending therethrough wherein the coupling 250 is coaxial with the boss 244 connected to the disc 242. The boss 244 and the coupling 250 house a bearing assembly 254 as seen in FIG. 6, that is disposed within the apertures 246 formed in the boss 244 and the coupling 250 of the end plate 240 so as to rotatably support the central shaft 224 of the rotor assembly 212.

As seen in FIGS. 2-6, the end plate 240 includes longitudinal braces 258, which are configured as rods 260 in the illustrated embodiment, that support the screen frame assembly 210. A pair of handles 262 are connected to and extend away from the disc 242 of the end plate 240 to provide tactile surfaces allowing a user to grip and move the end plate 240 between the first position, as shown in FIG. 2, and the second position, as shown in FIGS. 3-5. The end plate 240 further includes a pivot plate 264 that is mounted to a lower end bracket 266 connected to the disc 242 of the end plate 240 such that the pivot plate 264 is positioned above the upper ends $\mathbf{118}_B$ of the rearward legs $\mathbf{116}_B$. The pivot plate 264 defines a plurality of apertures 268 that are configured and dimensioned to receive fasteners 270 (e.g., screws, bolts, etc.) to connect the pivot plate 264 to a pivot bearing 272.

In order to provide pivotal rotation of the pivot plate 264, the pivot bearing 272 provides a rotatable interface between the pivot plate 264 of the end plate 240 and a guide plate 274 that is slidably connected to the guide rails $\mathbf{124}_A$, $\mathbf{124}_B$. The pivot bearing 272 includes respective inner and outer rings 276, 278 that are configured, dimensioned, and adapted for relative rotation. More specifically, the outer ring 278 is received within an opening 280 defined by the guide plate 274 such that the inner ring 276 is rotatable in relation to the outer ring 278 and the guide plate 274. The inner ring 276 includes apertures 282 positioned in correspondence with the apertures 268 formed in the pivot plate 264 such that the fasteners 270 extend through the pivot plate 264 into the apertures 282 formed in the inner ring 276.

To provide linear motion along the guide rails $\mathbf{124}_A$, $\mathbf{124}_B$, the guide plate 274 includes a central body portion 284 and lateral wings $\mathbf{286}_A$, $\mathbf{286}_B$ that extend integrally and outwardly from the central body portion 284 to form a substantially U-shaped structure. The central body portion 284 and the wings $\mathbf{286}_A$, $\mathbf{286}_B$ are generally planar in configuration, and the central body portion 284 defines the opening 280 that receives the pivot bearing 272. Each of the wings $\mathbf{286}_A$, $\mathbf{286}_B$ supports a tubular guide 288 that is connected to and extends from the underside of the wings $\mathbf{286}_A$, $\mathbf{286}_B$ thereby defining a channel 290 within the tubular guides 288 that is configured and dimensioned to slidably receive the guide rails $\mathbf{124}_A$, $\mathbf{124}_B$ such that the tubular guides 288 and the guide plate 274 are longitudinally slidable along the guide rails $\mathbf{124}_A$, $\mathbf{124}_B$ to allow for longitudinal movement of the guide plate 274 (e.g., in relation to the secondary stand 104, the housing 206 of the body assembly 200, and the drive mechanism 234). The guide plate 274 is configured such that the wings $\mathbf{286}_A$, $\mathbf{286}_B$ are axially offset from the opening 280 so as to define longitudinal recesses $\mathbf{292}_A$, $\mathbf{292}_B$ that accommodate the upper ends $\mathbf{118}_B$ of the legs $\mathbf{116}_B$ of the secondary stand 104 as the end plate 240 is moved from the first position as shown in FIG. 2, into the second position, as shown in FIGS. 3-6.

As can be appreciated through reference to FIGS. 3, 4, and 6, the assembly of the pivot plate 264, the pivot bearing 272, and the guide plate 274 allows for relative rotation between the pivot plate 264 and the guide plate 274. More specifically, the pivot plate 264 is rotatable about a vertical axis Y such that the end plate 240, and thus, the screen frame assembly 210 and the rotor assembly 212, are repositionable between a first angular position and a second angular position offset from the first angular position by an angle α. In the first angular position, the end plate 240, the screen frame assembly 210, and the rotor assembly 212 are generally aligned with the longitudinal axis X defined by the base assembly 100, and in the second angular position, the end plate 240, the screen frame assembly 210, and the rotor assembly 212 are generally misaligned with the longitudinal axis X. It is envisioned that the guide plate 274, the pivot bearing 272, and the pivot plate 264 may be configured, dimensioned, adapted, and connected to achieve any desired value for the angle α. For example, in one embodiment, it is envisioned that the angle α may be limited (e.g., to 45° or 90°). Alternatively, however, the angle α may not be limited such that the end plate 240, the screen frame assembly 210, and the rotor assembly 212 are freely rotatable (i.e., such that the angle α is customer driven).

To restrict angular movement, it is envisioned that a locking mechanism 294, as shown in FIG. 6, may be provided, which may be any member, structure, or mechanism suitable for the intended purpose of limiting rotation of the end plate 240 in relation to the guide plate 274. For example, the locking mechanism 294 may include a spring-loaded pin 296 that is receivable within a corresponding aperture 298 (e.g., an opening, slot, etc.) formed in the guide plate 274.

With reference now to FIG. 2-6, to inspect and clean the rotor assembly 212 and the screen frame assembly 210, the end plate 240 is disengaged from the body assembly 200 through the use of conventional fasteners, and the side door(s) 208 are opened. The operator then uses the handles 262 on the end plate 240 to separate and pull the end plate 240 longitudinally away from the body assembly 200, which causes the guide plate 274 to slide along the guide rails $\mathbf{124}_A$, $\mathbf{124}_B$ via the tubular guides 288 through the interface provided by the pivot bearing 272 between the guide plate 274 and the pivot plate 264. By positioning the guide rails $\mathbf{124}_A$, $\mathbf{124}_B$ on opposing sides of the base assembly 100, stability of the rotor assembly 212 and screen frame assembly 210 is increased during axial movement of the rotor assembly 212 and the screen frame assembly 210. As the end plate 240 is moved away from the body assembly 200, the rotor assembly 212 and the screen frame assembly 210 are extricated from the housing 206. Separation of the end plate 240 from the housing 206 is continued until the rotor assembly 212 and the screen frame assembly 210 are clear of the housing 206, as illustrated in FIG. 4, for example.

As seen in FIGS. 4-5, when the rotor assembly 212 and the screen frame assembly 210 are fully removed from the housing 206, the pivot plate 264 is positioned above the upper ends $\mathbf{118}_B$ of the rearward legs $\mathbf{116}_B$, and the guide plate 274 is positioned within the gap G (as seen in FIG. 6) defined between the rail guide plate 132 and the rearward legs $\mathbf{116}_B$. More specifically, the gap G is configured and dimensioned to receive the central body portion 284 of the guide plate 274 such that the guide plate 274 extends beyond the rail guide plate 132. The locking mechanism 294 (as seen in FIG. 6) can then be disengaged to allow for rotation of the end plate 240 about the Y axis (e.g., in the direction indicated by arrow 1 in FIG. 4), during which the pivot plate 264 (as seen in FIG. 6) is rotated in relation to the guide plate 274 via the pivot bearing 272 such that the pivot plate 264 passes over the upper ends $\mathbf{118}_B$ of the rearward legs $\mathbf{116}_B$. The screen frame assembly 210 can then be removed from the rotor assembly 212 to allow for the cleaning and inspection of the screen frame assembly 210 and the rotor assembly 212, during which the rotor assembly 212 may remain connected to, and supported by, the end plate 240. After cleaning and inspection, the screen frame assembly 210 and the rotor assembly 212 can be reassembled. It is envisioned that the continual support provided by the end plate 240 to the rotor assembly 212 and the screen frame assembly 210 may simplify, or completely eliminate the need for, manual alignment of the various components of the sifter 1000 (e.g., the rotor assembly 212 and the drive mechanism 234), as is traditionally required in connection with known rotary sifters (e.g. the rotary sifter 1 seen in FIG. 1).

Following reassembly of the screen frame assembly 210 and the rotor assembly 212, the end plate 240, the rotor assembly 212, and the screen frame assembly 210 can be returned to the position illustrated in FIG. 3 via rotation about the Y axis (e.g., in the direction indicated by arrow 2 in FIG. 4). The screen frame assembly 210 and the rotor assembly 212 can then be reinserted into the housing 206, and the end plate 240 can then be secured to the body assembly 200 through conventional fasteners.

As seen in FIG. 2, the drive mechanism 234 and the end plate 240 are positioned adjacent opposing (longitudinal) ends $\mathbf{300}_A$, $\mathbf{300}_B$ of the housing 206. By separating the motor 236 from the end plate 240, the rotor assembly 212 and the screen frame assembly 210 can be removed from the body assembly 200 without requiring movement of the motor 236. By eliminating movement and relocation of the motor 236 from the extrication process, the process is simplified by reducing not only the number of components involved, but the overall weight that must be accommodated. Moreover, by providing continual support to the end plate 240, the rotor assembly 212, and the screen frame assembly 210 via the guide rails 124A, 124B and the secondary stand 104, it is envisioned that assembly, inspection, cleaning, and reassembly of the rotary sifter 1000 may be performed by a single individual.

Persons skilled in the art will understand that the various embodiments of the disclosure described herein and shown in the accompanying figures constitute non-limiting examples, and that additional components and features may be added to any of the embodiments discussed hereinabove without departing from the scope of the present disclosure. Additionally, persons skilled in the art will understand that the elements and features shown or described in connection with one embodiment may be combined with those of another embodiment without departing from the scope of the present disclosure, and will appreciate further features and advantages of the presently disclosed subject matter based on the description provided. Variations, combinations, and/or modifications to any of the embodiments and/or features of the embodiments described herein that are within the abilities of a person having ordinary skill in the art are also within the scope of the disclosure, as are alternative embodiments that may result from combining, integrating, and/or omitting features from any of the disclosed embodiments.

Use of the term "optionally" with respect to any element of a claim means that the element may be included or omitted, with both alternatives being within the scope of the claim. Additionally, use of broader terms such as "comprises," "includes," and "having" should be understood to provide support for narrower terms such as "consisting of," "consisting essentially of," and "comprised substantially of." Accordingly, the scope of protection is not limited by the description set out above, but is defined by the claims that follow, and includes all equivalents of the subject matter of the claims.

In the preceding description, reference may be made to the spatial relationship between the various structures illustrated in the accompanying drawings, and to the spatial orientation of the structures. However, as will be recognized by those skilled in the art after a complete reading of this disclosure, the structures described herein may be positioned and oriented in any manner suitable for their intended purpose. Thus, the use of terms such as "above," "below," "upper," "lower," "inner," "outer," "upward," "downward," "inward," "outward," etc., should be understood to describe a relative relationship between structures and/or a spatial orientation of the structures. Those skilled in the art will also recognize that the use of such terms may be provided in the context of the illustrations provided by the corresponding figure(s).

Additionally, terms such as "approximately," "generally," "substantially," and the like should be understood to allow for variations in any numerical range or concept with which they are associated. For example, it is intended that the use of terms such as "approximately" and "generally" should be understood to encompass variations on the order of 25%, or to allow for manufacturing tolerances and/or deviations in design.

Each and every claim is incorporated as further disclosure into the specification, and represents embodiments of the present disclosure. Also, the phrases "at least one of A, B, and C" and "A and/or B and/or C" should each be interpreted to include only A, only B, only C, or any combination of A, B, and C.

The invention claimed is:

1. A rotary sifter, comprising:

a body assembly including a housing, a screen frame assembly positioned within the housing, and a rotor assembly mounted for rotation within the screen frame assembly;

a drive mechanism in mechanical cooperation with the rotor assembly to rotate the rotor assembly, the drive mechanism being axially fixed in relation to the housing, the screen frame assembly, and the rotor assembly; and a base assembly supporting the body assembly and the drive mechanism, the base assembly including a guide rail system configured and dimensioned to permit longitudinal movement of the rotor assembly and the screen frame assembly in relation to the housing and the drive mechanism to allow for removal of the rotor assembly and the screen frame assembly from the housing.

2. The rotary sifter of claim 1, wherein the drive mechanism is disconnectable from the rotor assembly such that the rotor assembly and the screen frame assembly can be removed from the housing without the drive mechanism.

3. The rotary sifter of claim 2, wherein the body assembly includes an end plate supporting the screen frame assembly and the rotor assembly such that the endcap is movable in conjunction with the screen frame assembly and the rotor assembly.

4. The rotary sifter of claim 3, wherein the end plate is configured and dimensioned for axial and rotational movement in relation to the housing to cause corresponding axial and rotational movement of the screen frame assembly and the rotor assembly.

5. The rotary sifter of claim 4, wherein the end plate includes a pivot plate connectable to a pivot bearing to facilitate rotation of the pivot plate and the end plate in relation to the housing.

6. The rotary sifter of claim 5, wherein the pivot bearing includes an outer ring and an inner ring in mechanical engagement with the outer ring such that the inner ring is rotatable in relation to the outer ring, the pivot plate being connectable to the inner ring.

7. The rotary sifter of claim 5, further including a guide plate configured and dimensioned to support the pivot bearing such that the pivot bearing is rotatable in relation to the guide plate.

8. The rotary sifter of claim 7, wherein the guide plate is in mechanical engagement with the guide rail system such that the guide plate is longitudinally movable along the guide rail system together with the end plate, the screen frame assembly, and the rotor assembly.

9. The rotary sifter of claim 8, wherein the guide rail system includes a first guide rail and a second guide rail, the first and second guide rails being laterally offset.

10. The rotary sifter of claim 9, wherein the first and second guide rails are positioned on opposing sides of the base assembly.

11. A rotary sifter, comprising:

a base assembly;

a body assembly positioned atop the base assembly, the body assembly including an end plate that is movable in relation to a housing of the body assembly, the end cap connected to a rotor assembly and a screen frame assembly positioned within the housing; and a drive mechanism in mechanical cooperation with the rotor assembly to rotate the rotor assembly within the housing, the drive mechanism and the end plate being positioned adjacent opposing longitudinal ends of the housing such that the end plate, the rotor assembly, and the screen frame assembly are concomitantly movable in relation to the drive mechanism.

12. The rotary sifter of claim 11, wherein the end plate, the rotor assembly, and the screen frame assembly are axially movable in relation to the housing such that the rotor assembly and the screen frame assembly are removable from the housing.

13. A rotary sifter, comprising:

a base assembly;

a body assembly positioned atop the base assembly, the body assembly including an end plate supporting a rotor assembly and a screen frame assembly;

a drive mechanism in mechanical cooperation with the rotor assembly to rotate the rotor assembly within the housing, the drive mechanism and the endcap being positioned adjacent opposing longitudinal ends of the housing such that the endcap, the rotor assembly, and the screen frame assembly are concomitantly movable in relation to the drive mechanism, wherein the endcap, the rotor assembly, and the screen frame assembly are axially movable in relation to the housing such that the rotor assembly and the screen frame assembly are removable from the housing; and a longitudinal guide rail system supporting the end plate to permit axial movement of the end plate, the rotor assembly, and the screen frame assembly in relation to the housing.

14. The rotary sifter of claim 13, wherein the guide rail system includes a first guide rail and a second guide rail, the first and second guide rails being laterally offset and substantially parallel to one another.

15. The rotary sifter of claim 14, wherein the first and second guide rails are positioned on opposing sides of the base assembly.

16. The rotary sifter of claim 13, wherein the end plate, the rotor assembly, and the screen frame assembly are configured, dimensioned, and connected for concomitant rotation in relation to the housing.

17. The rotary sifter of claim 16, wherein the end plate includes a pivot plate connectable to a rotatable pivot bearing to facilitate rotation of the pivot plate and the end plate in relation to the housing.

18. The rotary sifter of claim 17, further including a guide plate configured and dimensioned to support the pivot bearing such that the pivot bearing is rotatable in relation to the guide plate.

19. The rotary sifter of claim 18, wherein the guide plate defines an opening configured and dimensioned to receive the pivot bearing.

* * * * *